United States Patent [19]

Nakata et al.

[11] Patent Number: 4,724,416

[45] Date of Patent: Feb. 9, 1988

[54] VOLTAGE NON-LINEAR RESISTOR AND ITS MANUFACTURE

[75] Inventors: Masami Nakata, Chita; Osamu Imai, Kasugai, both of Japan

[73] Assignee: NGK Insulators, Ltd., Japan

[21] Appl. No.: 19,668

[22] Filed: Feb. 27, 1987

[30] Foreign Application Priority Data

Apr. 9, 1986 [JP] Japan ..... 61-79983

[51] Int. Cl.[4] ..... H01C 7/10

[52] U.S. Cl. ..... 338/20; 338/21; 252/518; 252/519; 29/610 R

[58] Field of Search ..... 338/20, 21; 252/518, 252/519, 520, 521; 29/592 R, 610 R

[56] References Cited

U.S. PATENT DOCUMENTS 4,386,021 5/1983 Kazuo et al. .
4,551,268 11/1985 Eda et al. .

FOREIGN PATENT DOCUMENTS 59-41285 10/1984 Japan .
59-41286 10/1984 Japan .
60-4563 2/1985 Japan .

*Primary Examiner*—E. A. Goldberg
*Assistant Examiner*—M. M. Lateef
*Attorney, Agent, or Firm*—Parkhurst & Oliff

[57] ABSTRACT

A voltage non-linear resistor excellent in lightning discharge current withstanding capability and electrical life performance against applied voltage comprises a disclike voltage non-linear element and a thin insulating covering layer integrally provided on the side surface of the element. In the resistor according to the invention, the element contains zinc oxides as main ingredient, 0.1–2.0% bismuth oxides, as $Bi_2O_3$, 0.1–2.0% cobalt oxides, as $Co_2O_3$, 0.1–2.0% manganese oxides, as $MnO_2$, 0.1–2.0% antimony oxides, as $Sb_2O_3$, 0.1–2.0% chromium oxides, as $Cr_2O_3$, 0.1–2.0% nickel oxides, as NiO, 0.001–0.05% aluminum oxides, as $Al_2O_3$, 0.005–0.1% boron oxides, as $B_2O_3$, 0.001–0.05% silver oxides, as $Ag_2O$ and 1–3% silicon oxides, as $SiO_2$, and the layer contains 80–96% silicon oxides, as $SiO_2$, 2–7% bismuth oxides, as $Bi_2O_3$ and antimony oxides for the remainder (% stands for mole %). The resistor of the invention preferably further has a thin glassy layer superimposed on the insulating covering layer. The resistors are advantageously adaptable to arrestors, surge absorbers used in high voltage power systems.

10 Claims, No Drawings

VOLTAGE NON-LINEAR RESISTOR AND ITS MANUFACTURE

BACKGROUND OF THE INVENTION

1. Field of the Invention

The present invention relates to a voltage non-linear resistor comprising, as its main ingredient, zinc oxides, and more particularly a voltage non-linear resistor which is excellent in lightning discharge current withstanding capability and exhibits a strong coherency between its disclike resistance element and insulating covering layer, and also to a process for manufacturing the same.

2. Description of the Prior Art

As a manufacturing process of voltage non-linear resistors having been heretofore extensively utilized in voltage stabilizing devices, surge absorbers, arrestors, etc. which have characteristics of acting as an insulator usually but as a conductor when an overcurrent flows, is widely known, for example, a process for manufacturing a voltage non-linear resistor by forming a disclike body from a starting material mixture consisting of 0.1–3.0% $Bi_2O_3$, 0.1–3.0% $Co_2O_3$, 0.1–3.0% $MnO_2$, 0.1–3.0% $Sb_2O_3$, 0.05–1.5% $Cr_2O_3$, 0.1–3.0% NiO, 0.1–10.0% $SiO_2$, 0.0005–0.025% $Al_2O_3$, 0.005–0.3% $B_2O_3$ and the remainder of ZnO (% stands for mole %) and then sintering the formed body.

Further, when voltage non-linear resistors obtained by the above-described process are used under high humid conditions, resistivity at the peripheral side surface of the discal element decreases and, therefore, an improved process for manufacturing a voltage non-linear resistor, taking measures for humidity proof, by providing the peripheral side surface with a high resistance layer composed of an epoxy resin or the like has also been known.

Conventional voltage non-linear resistors manufactured by the above-mentioned processes have such a wide composition range of components and such a low cohering strength between the resistance element and the high resistance layers on its peripheral side surface that flashover of the element due to lightning discharge current, etc. has been unable to be effectively prevented. Further, since the voltage non-linear resistors manufactured by conventional processes are poor in uniformity at each part, a big current locally flows upon application of lightning discharge current, etc., which sometimes causes to destroy the resistors. Consequently, a voltage non-linear resistor satisfactory in lightning discharge current withstanding capability that is particularly important in protection of an electrical insulator, has not always been obtainable.

SUMMARY OF THE INVENTION

The object of the present invention is, obviating the above-mentioned inconvenience, to provide a voltage non-linear resistor which is excellent in lightning discharge current withstanding capability.

The process of the present invention for manufacturing a voltage non-linear resistor is characterized by applying a mixture comprising 80–96% silicon oxides calculated as $SiO_2$, 2–7% bismuth oxides calculated as $Bi_2O_3$ and antimony oxides for the remainder on a peripheral side surface of a disclike voltage non-linear resistance element comprising zinc oxides as a main ingredient, 0.1–2.0% bismuth oxides calculated as $Bi_2O_3$, 0.1–2.0% cobalt oxides calculated as $Co_2O_3$, 0.1–2.0% manganese oxides calculated as $MnO_2$, 0.1–2.0% antimony oxides calculated as $Sb_2O_3$, 0.1–2.0% chromium oxides calculated as $Cr_2O_3$, 0.1–2.0% nickel oxides calculated as NiO, 0.001–0.05% aluminum oxides calculated as $Al_2O_3$, 0.005–0.1% boron oxides calculated as $B_2O_3$, 0.001–0.05% silver oxides calculated as $Ag_2O$ and 1–3% silicon oxides calculated as $SiO_2$ (% stands for mole %), and then sintering the element, whereby an insulating covering layer is provided integrally on said surface.

DESCRIPTION OFTHE PREFERRED EMBODIMENTS

In the above-described structure, the definition of the composition of the voltage non-linear resistance element, in particular, that the content of silicon oxides be 1–3 mol. % as $SiO_2$ and the definition of the composition of the mixture for the insulating covering layer to be applied on the peripheral side surface, in particular, that the content of silicon oxides be 80–96 mol. % as $SiO_2$, synergistically increase the cohering strength between the voltage non-linear resistance element and the insulating covering layer, so that a flashover at the peripheral side surface otherwise caused by an imperfect coherency of insulating covering layer can be effectively prevented.

Further, by defining the composition of the element, particularly, the content of silicon oxides to be 1–3 mol. % as $SiO_2$, the uniformity at each and every part of the element can be improved. Thereby a current concentration caused by unevenness of element can be prevented and an improvement in lightning discharge current withstanding capability can be achieved.

Furthermore, the whys and wherefores of defining the content of each ingredient in the voltage non-linear resistance element are as follow.

The bismuth oxides constitute a microstructure, as a grain boundary phase, among zinc oxides grains, while they act to promote growth of the zinc oxides grains. If the bismuth oxides are in an amount of less than 0.1 mol. % as $Bi_2O_3$, the grain boundary phase is not sufficiently formed, and-an electric barrier height formed by the grain boundary phase is lowered to increase leakage currents, whereby non-linearity in a low current region will be deteriorated. If the bismuth oxides are in excess of 2 mol. %, the grain boundary phase becomes too thick or the growth of the zinc oxides grain is promoted, whereby a discharge voltage ratio ($V^{10KA}/V_{1mA}$) will be deteriorated. Accordingly, the addition amount of the bismuth oxides is limited to 0.1–2.0 mol. %, preferably 0.5–1.2 mol. %, calculated as $Bi_2O_3$.

The cobalt oxides and manganese oxides, a part of which forms solid solutions in zinc oxides grains and another part of which deposits in the grain boundary phase, serve to raise the electric barrier height. If either of them is in an amount of less than 0.1 mol. % as $Co_2O_3$ or $MnO_2$, the electric barrier height will be so lowered that non-linearity in a low current region will be deteriorated, while if in excess of 2 mol. %, the grain boundary phase will become so thick that the discharge voltage ratio will be deteriorated. Accordingly, the respective addition amounts of the cobalt oxides and manganese oxides are limited to 0.1–2.0 mol. % calculated as $Co_2O_3$ and $MnO_2$, preferably 0.5–1.5 mol. % for cobalt oxides and 0.3–0.7 mol. % for manganese oxides.

The antimony oxides, chromium oxides and nickel oxides which react with zinc oxides to form a spinel phase suppress an abnormal growth of zinc oxides grains and serve to improve uniformity of sintered bodies. If any oxides of these three metals are in an amount of less than 0.1 mol. %, calculated as the oxides defined hereinabove, i.e., $Sb_2O_3$, $CrO_3$ or NiO, the abnormal growth of zinc oxides grains will occur to induce nonuniformity of current distribution in sintered bodies, while if in excess of 2.0 mol. % as the defined oxide form, insulating spinel phases will increase too much and also induce the nonuniformity of current distribution in sintered bodies. Accordingly, respective amounts of the antimony oxides, chromium oxides and nickel oxides are limited to 0.1–2.0 mol. % calculated as $Sb_2O_3$, $Cr_2O_3$ and NiO, preferably 0.8–1.2 mol. % as $Sb_2O^3$, 0.3–b 0.7 mol. % as $Cr_2O_3$ and 0.8–1.2 mol. % as NiO.

The aluminum oxides which form solid solutions in zinc oxides act to reduce the resistance of the zinc oxides containing element. If the aluminum oxides are in an amount of less than 0.001 mol. % as $Al_2O_3$, the electrical resistance of the element cannot be reduced to a sufficiently small value, so that the discharge voltage ratio will be deteriorated, while, if in excess of 0.05 mol. %, the electric barrier height will be so lowered that the non-linearity in a low current region will be deteriorated. Accordingly, its addition amount is limited to 0.001–0.05 mol. %, preferably 0.002–0.005 mol. %, calculated as $Al_2O_3$.

The boron oxides deposit along with the bismuth oxides and silicon oxides in the grain boundary phase, serve to promote the growth of zinc oxides grains as well as to vitrify and stabilize the grain boundary phase. If the boron oxides are in an amount of less than 0.005 mol. % as $B_2O_3$, the effect on the grain boundary phase stabilization will be insufficient, while, if in excess of 0.1 mol. %, the grain boundary phase will become too thick, so that the discharge voltage ratio will be deteriorated. Accordingly, the addition amount of the boron oxides is limited to 0.005–0.1 mol. %, preferably 0.01–0.08 mol. %, calculated as $B_2O_3$.

The silver oxides deposit in the grain boundary phase, act to suppress ion migration caused by an applied voltage, to thereby stabilize the grain boundary phase. If the silver oxides are in an amount of less than 0.001 mol. % as $Ag_2O$, the effect on the grain boundary phase stabilization will be insufficient, while, if in excess of 0.05 mol. %, the grain boundary phase will become so unstable, whereby the discharge voltage ratio will be deteriorated. Accordingly, the addition amount of the silver oxides is limited to 0 001–0.05 mol. %, preferably 0.005–0.03 mol. %, calculated as $Ag_2O$.

The silicon oxides deposit along with the bismuth oxides in the grain boundary phase, serve to suppress the growth of zinc oxides grains as well as to increase a varistor voltage. If the silicon oxides are in an amount of less than 1 mol. % as $SiO_2$, the effect on the growth suppression of zinc oxides grains will be insufficient and a silicon oxides containing composition deposits ununiformly in the grain boundary phase. In consequence, the uniformity of element will be impaired so that a current concentration will become liable to arise with lightning discharge current. Besides, since the coherency of the peripheral side surface of the element with the insulating covering layer becomes low, the lightning discharge current withstanding capability will decrease. If the amount is in excess of 3 mol. % as $SiO_2$, the grain boundary phase will become too thick so that the performance of the element will be deteriorated. Accordingly, the addition amount of silicon oxides is limited to 1–3 mol. %, preferably 1.5–2.0 mol. %, as $SiO_2$.

Further, with respect to the composition of mixtures for insulating covering layer to be provided on the peripheral side surface of the disclike voltage nonlinear resistance element, if the silicon oxides are in an amount of less than 80 mol. % as $SiO_2$, the lightning discharge current withstanding capability will not improve, while, if in excess of 96 mol. %, the coherency of the insulating covering layer will be lowered. Accordingly, the addition amount of silicon oxides is limited to 80–96 mol. %, preferably 85–90 mol. %, calculated as $SiO_2$.

Furthermore, if the insulating covering layer is less than 30 μm thick, its effect will be lost, while, if thicker than 100 μm, its coherency will become insufficient so as to induce liability to exfoliation. Accordingly, the thickness is preferred to be 30–100 μm.

As the above, the amount of the silicon oxides in the element and that in the insulating covering layer provided on the element play an important role in improvement of lightning discharge current withstanding capability of the element, the mechanism of which is accounted as follows.

The insulating covering layer is formed from a mixture for insulating cover comprising silicon oxides, antimony oxides and bismuth oxides, which is applied onto the element and then reacts with zinc oxides in the element during the subsequent sintering. This insulating covering layer consists mainly of zinc silicate ($Zn_2SiO_4$) derived from reaction of zinc oxides with silicon oxides and a spinel ($Zn_{1/3}Sb_{2/3}O_4$) derived from reaction of zinc oxides with antimony oxides, which are formed at portions where the zinc silicate is in contact with the element. Therefore, it is considered that silicon oxides in the mixture for insulating cover play an important role in coherency between the element and the insulating covering layer.

Further, if the amount of the silicon oxides in the element increases, the amount of zinc silicate deposits in the grain boundary phase of the element also increases. From the above, it is considered that wettability between the element and the insulating covering layer is improved, resulting in an improvement in coherency between the element and the insulating covering layer.

On the other hand, the bismuth oxides serve as a flux which acts to promote the above-described reactions smoothly. Accordingly, they are preferred to be contained in an amount of 2–7 mol. %, as $Bi_2O_3$.

In order to obtain a voltage non-linear resistor comprising zinc oxides as a main ingredient, a zinc oxides material having a particle size adjusted as predetermined is mixed, for 50 hours in a ball mill, with a predetermined amount of an additive comprising respective oxides of Bi, Co, Mn, Sb, Cr, Si, Ni, Al, B, Ag, etc. having a particle size adjusted as predetermined. The thus prepared starting powder is added with a predetermined amount of polyvinylalcohol aqueous solution as a binder and, after granulation, formed into a predetermined shape, preferably a disc, under a forming pressure of 800–1,000 kg/cm$^2$. The formed body is provisionally calcined under conditions of heating and cooling rates of 50°–70° C./hr. and a retention time at 800°–1,000° C. of 1–5 hours, to expel and remove the binder.

Next, the insulating covering layer is formed on the peripheral side surface of the provisional calcined discal body. In the present invention, an oxide paste comprising bismuth oxides, antimony oxides and silicon oxides admixed with ethyl-cellulose, butyl carbitol, n-butylacetate or the like as an organic binder, is applied to form layers 60–300 μm thick on the peripheral side surface of the provisional calcined disclike body. Then, this is subjected to a main sintering under conditions of heating and cooling rates of 40°–60° C./hr. and a retention time at 1,000°–1,300° C., preferably at 1,150°–1,250° C., of 2–7 hours, and a voltage non-linear resistor comprising a discal element and an insulating covering layer with a thickness of about 30–100 μm is obtained.

Besides, it is preferred that a glass paste comprising glass powder admixed with ethylcellulose, butyl carbitol, n-butyl acetate or the like as an organic binder, is applied with a thickness of 100–300 μm onto the aforementioned insulating covering layer and then heat-treated in air under conditions of heating and cooling rates of 100°–200° C./hr. and a temperature retention time at 400°–600° C. of 0.5–2 hours, to superimpose a glassy layer with a thickness of about 50–100μm.

Then lastly, both the top and bottom flat surfaces of the disclike voltage non-linear resistor are polished to smooth and provided with aluminum electrodes by means of metallizing.

With respect to voltage non-linear resistors prepared with compositions respectively inside and outside the scope of the invention, results of measurement on various characteristics will be explained hereinafter.

In examples, the bismuth oxides, antimony oxides and silicon oxides are contained as an oxide paste and, needless to say, an equivalent effect will be realized with carbonates, hydroxides, etc. which can be converted to oxides during the firing. Also it is needless to say that, other than silicon, antimony and bismuth compounds, any materials not to impair effects of these compounds may be added to the paste in accordance with the purpose of use of the non-linear resistor. On the other hand, with respect to the composition of the element, also the same can be said.

EXAMPLE 1

Specimens of disclike voltage non-linear resistor of 47 mm in diameter and 20 mm in thickness were prepared in accordance with the above-described process, which had silicon oxides contents calculated as SiO2 in the discal element and the mixture for insulating covering layer on the peripheral side surface of the element, either inside or outside the scope of the invention, as shown in Table 1 below. With respect to each specimen, appearance of element and lightning discharge current withstanding capability were evaluated. The insulating covering layer of every specimen had a thickness in the range of 30–100 μm, and voltage non-linear resistors were provided with a glassy layer 50–100 μm thick. The result is shown in Table 1. For the appearance of element in Table 1, the mark O denotes no exfoliation of insulating covering layer observed apparently and the mark × denotes exfoliation observed. Further, the lightning discharge current withstanding capability means withstandability against impulse current having a waveform of 4×10 μs and, the mark O denotes no flashover occurred upon twice applications and the mark × denotes flashover occurred.

TABLE 1

| Specimen No. | Composition of Element (mol. %) | | | | | | | | | | |
|---|---|---|---|---|---|---|---|---|---|---|---|
| | $Bi_2O_3$ | $Co_2O_3$ | $MnO_2$ | $Sb_2O_3$ | $Cr_2O_3$ | NiO | $SiO_2$ | $Al_2O_3$ | $B_2O_3$ | $Ag_2O$ | ZnO |
| 1 | 0.1 | 0.1 | 2 | 1.5 | 1.0 | 0.1 | 0.5 | 0.001 | 0.005 | 0.005 | remainder |
| 2 | 0.5 | 1.5 | 0.5 | 0.1 | 0.5 | 1 | " | 0.01 | 0.05 | 0.001 | " |
| 3 | 0.7 | 2 | 1 | 0.5 | 0.1 | 0.5 | " | 0.005 | 0.01 | 0.01 | " |
| 4 | 1 | 1 | 1.5 | 2 | 1.5 | 1.5 | " | 0.01 | 0.1 | 0.05 | " |
| 5 | 2 | 0.5 | 0.1 | 1 | 2 | 2 | " | 0.05 | 0.03 | 0.01 | " |
| 6 | 0.1 | 1.5 | 2 | 1.5 | 0.1 | 2.0 | 1.0 | 0.001 | 0.1 | 0.001 | " |
| 7 | 0.5 | 1.0 | 1.5 | 1.0 | 1.0 | 0.1 | " | 0.005 | 0.005 | 0.01 | " |
| 8 | 0.7 | 0.5 | 0.5 | 0.5 | 0.5 | 1.0 | " | 0.005 | 0.03 | 0.005 | " |
| 9 | 1 | 0.1 | 1 | 2 | 1.5 | 0.5 | " | 0.01 | 0.01 | 0.01 | " |
| 10 | 2 | 2 | 0.1 | 0.1 | 2.0 | 1.5 | " | 0.05 | 0.05 | 0.05 | " |
| 11 | 0.1 | 0.5 | 2 | 2 | 1.5 | 0.1 | 2.0 | 0.005 | 0.1 | 0.05 | " |
| 12 | 0.5 | 0.1 | 1.5 | 1 | 1 | 2 | " | 0.001 | 0.005 | 0.001 | " |
| 13 | 0.7 | 1.0 | 0.5 | 0.5 | 0.5 | 1.0 | " | 0.005 | 0.03 | 0.005 | " |
| 14 | 1 | 2 | 1.0 | 0.1 | 0.1 | 0.5 | " | 0.01 | 0.01 | 0.01 | " |
| 15 | 2 | 1.5 | 0.1 | 1.5 | 2 | 1.5 | " | 0.05 | 0.05 | 0.01 | " |
| 16 | 0.1 | 2.0 | 1.5 | 2.0 | 2.0 | 2 | 3.0 | 0.05 | 0.005 | 0.01 | " |
| 17 | 0.5 | 0.1 | 2 | 1.5 | 0.1 | 1.5 | " | 0.005 | 0.03 | 0.001 | " |
| 18 | 0.7 | 1.5 | 0.1 | 0.5 | 1.5 | 1.0 | " | 0.001 | 0.01 | 0.05 | " |
| 19 | 1 | 0.5 | 1.0 | 0.1 | 0.5 | 0.5 | " | 0.01 | 0.05 | 0.005 | " |
| 20 | 2 | 1.0 | 0.5 | 1.0 | 1.0 | 0.1 | " | 0.01 | 0.1 | 0.05 | " |
| 21 | 0.1 | 2.0 | 2.0 | 0.1 | 2.0 | 1.5 | 4.0 | 0.001 | 0.03 | 0.05 | " |
| 22 | 0.5 | 0.1 | 0.1 | 1 | 1.5 | 0.5 | " | 0.005 | 0.005 | 0.001 | " |
| 23 | 0.7 | 1.5 | 0.5 | 1.5 | 0.1 | 1.0 | " | 0.005 | 0.01 | 0.01 | " |
| 24 | 1 | 0.5 | 1.0 | 2.0 | 1.0 | 0.1 | " | 0.01 | 0.05 | 0.005 | " |
| 25 | 2 | 1.0 | 1.5 | 0.5 | 0.5 | 2 | " | 0.05 | 0.1 | 0.01 | " |

| Specimen No. | Composition of Mixture for Insulating Covering Layer (mol. %) | | | Appearance of Element | Lightning Discharge Current Withstanding Capability (KA) | | | | | |
|---|---|---|---|---|---|---|---|---|---|---|
| | $SiO_2$ | $Bi_2O_3$ | $Sb_2O_3$ | | 100 | 110 | 120 | 130 | 140 | 150 |
| 1 | 75 | 7 | 18 | O | X | | | | | |
| 2 | 80 | 5 | 15 | O | X | | | | | |
| 3 | 85 | 5 | 10 | O | O | X | | | | |
| 4 | 96 | 2 | 2 | O | O | X | | | | |
| 5 | 98 | 1 | 1 | X | | | | | | |
| 6 | 75 | 7 | 18 | O | X | | | | | |
| 7 | 80 | 5 | 15 | O | O | O | O | O | O | X |
| 8 | 85 | 5 | 10 | O | O | O | O | O | O | X |
| 9 | 96 | 2 | 2 | O | O | O | O | O | X | |
| 10 | 98 | 1 | 1 | X | | | | | | |

TABLE 1-continued

| | | | | | | | | | | |
|---|---|---|---|---|---|---|---|---|---|---|
| 11 | 75 | 7 | 18 | O | O | O | X | | | |
| 12 | 80 | 5 | 15 | O | O | O | O | O | O | O |
| 13 | 85 | 5 | 10 | O | O | O | O | O | O | O |
| 14 | 96 | 2 | 2 | O | O | O | O | O | O | X |
| 15 | 98 | 1 | 1 | X | | | | | | |
| 16 | 75 | 7 | 18 | O | O | X | | | | |
| 17 | 80 | 5 | 15 | O | O | O | O | O | O | X |
| 18 | 85 | 5 | 10 | O | O | O | O | O | O | O |
| 19 | 96 | 2 | 2 | O | O | O | O | O | O | X |
| 20 | 98 | 1 | 1 | X | | | | | | |
| 21 | 75 | 7 | 18 | O | X | | | | | |
| 22 | 80 | 5 | 15 | O | O | X | | | | |
| 23 | 85 | 5 | 10 | O | O | O | X | | | |
| 24 | 96 | 2 | 2 | O | O | X | | | | |
| 15 | 98 | 1 | 1 | X | | | | | | |

As is clear from the result shown in Table 1, voltage non-linear resistors composed of an element and insulating covering layer both having a composition in the scope of the present invention are good in both appearance of element and lightning discharge current withstanding capability, while voltage non-linear resistors having either one of compositions outside the scope of the invention are not satisfactory in respect of the appearance of element and lightning discharge current withstanding capability.

EXAMPLE 2

Similarly, specimens of disclike voltage nonlinear resistor of 47 mm in diameter and 20 mm in thickness were prepared in accordance with the above-described process, the element of which had a composition specified to one point within the range defined according to the invention and the insulating covering layer of which had a variety of compositions, as shown in Table 2 below. With respect to each specimen, appearance of element and lightning discharge current withstanding capability were evaluated. The result is shown in Table 2.

TABLE 2

| Composition of Element (mol. %) | Composition of Mixture for Insulating Covering Layer (mol. %) | | | Appearance of Element | Lightning Discharge Current Withstanding Capability (KA) | | | | | |
|---|---|---|---|---|---|---|---|---|---|---|
| | $SiO_2$ | $Bi_2O_3$ | $Sb_2O_3$ | | 100 | 110 | 120 | 130 | 140 | 150 |
| $Bi_2O_3$: 0.5 | 75 | 7 | 18 | O | O | O | X | | | |
| $Co_2O_3$: 0.5 | 75 | 15 | 10 | O | O | X | | | | |
| $MnO_2$: 0.5 | 80 | 0 | 20 | O | O | O | O | X | | |
| $Sb_2O_3$: 0.5 | 80 | 2 | 18 | O | O | O | O | O | O | X |
| $Cr_2O_3$: 0.5 | 80 | 5 | 15 | O | O | O | O | O | O | O |
| NiO: 0.5 | 80 | 7 | 13 | O | O | O | O | O | O | X |
| $SiO_2$: 2.0 | 80 | 9 | 11 | O | O | O | O | X | | |
| $Al_2O_3$: 0.01 | 85 | 0 | 15 | O | O | O | O | O | X | |
| $B_2O_3$: 0.01 | 85 | 2 | 13 | O | O | O | O | O | O | X |
| $Ag_2O$: 0.01 | 85 | 5 | 10 | O | O | O | O | O | O | O |
| ZnO: remainder | 85 | 7 | 8 | O | O | O | O | O | O | X |
| | 85 | 9 | 6 | O | O | O | O | O | X | |
| | 96 | 0 | 4 | O | O | O | O | X | | |
| | 96 | 2 | 2 | O | O | O | O | O | O | X |
| | 96 | 4 | 0 | O | O | O | O | X | | |
| | 98 | 0 | 2 | X | X | | | | | |
| | 98 | 1 | 1 | X | X | | | | | |
| | 98 | 2 | 0 | X | X | | | | | |

As is clear fromthe result shown in Table 2, voltage non-linear rsistors comprising an insulating covering layer having a composition in the scope of the present invention are good in both the apearance of element and lightning discharge current withstanding capability, while voltage non-linear resistors comprising an insulating covering layer having a composition outside the scope of the present invention are not satisfactory in respect of the appearance of element and lightning discharge current withstanding capability.

While there has been shown and described the preferred embodiments of the present invention, it will be obvious to those skilled in the art that various alterations and modifications thereof can be made without departing from the scope of the invention as defined by the claims. For example, although metallized aluminum electrodes were used in the foregoing examples, other metals such as gold, silver, copper, zinc and the like, alloys thereof, etc. also can be used. With respect to the means to forming electrodes, use can be made of, not only metallizing, but also screen printing, vapor deposition, etc.

As is clear from the above detailed explanation, according to the process of the invention for manufacturing voltage non-linear resistors, by combination of a voltage non-linear resistance element with an insulating covering layer both having a specified composition, a voltage non-linear resistor can be obtained which has a strong coherency between the voltage non-linear resistance element and the insulating covering layer, and is consequently excellent in lightning discharge current withstanding capability as well as electrical life performance against applied voltage. The voltage non-linear resistors according to the present invention are, therefore, particularly suitable for uses of arrestors, surge absorbers, etc. such as employed in high voltage power systems.

What is claimed is:

1. A voltage non-linear resistor comprising a disclike voltage non-linear resistance element and a thin insulating covering layer integrally provided on a peripheral side surface of said disclike element, wherein said element comprises zinc oxides as a main ingredient, 0.1–2.0 mol. % bismuth oxides calculated as $Bi_2O_3$, 0.1–2.0 mol. % cobalt oxides calculated as $Co_2O_3$, 0.1–2.0 mol. % manganese oxides calculated as $MnO_2$, 0.1–2.0 mol. % antimony oxides calculated as $Sb_2O_3$, 0.1–2.0 mol. % chromium oxides calculated as $Cr_2O_3$, 0.1–2.0 mol. % nickel oxides calculated as NiO, 0.001–0.05 mol. % aluminum oxides calculated as $Al_2O_3$, 0.005–0.1 mol. % boron oxides calculated as $B_2O_3$, 0.001–0.05 mol. % silver oxides calculated as $Ag_2O$ and 1–3 mol. % silicon oxides calculated as $SiO_2$, and said layer comprises 80–96 mol. % silicon oxides calculated as $SiO_2$, 2–7 mol. % bismuth oxides calculated as $Bi_2O_3$ and antimony oxides for the remainder.

2. A voltage non-linear resistor as claimed in claim 1, wherein said element comprises 0.5–1.2 mol. % bismuth oxides, as $Bi_2O_3$, 0.5–1.5 mol. % cobalt oxides, as $Co_2O_3$, 0.3–0.7 mol. % manganese oxides, as $MnO_2$, 0.8–1.2 mol. % antimony oxides, as $Sb_2O_3$, 0.3–0.7 mol. % chromium oxides, as $Cr_2O_3$, 0.8–1.2 mol. % nickel oxides, as NiO, 0.002–0.005 mol. % aluminum oxides, as $Al_2O_3$, 0.001–0.08 mol. % boron oxides, as $B_2O_3$, 0.005–0.03 mol. % silver oxides, as $Ag_2O$, and 1.5–2.0 mol. % silicon oxides, as $SiO_2$, and said layer comprises 85–90 mol. % silicon oxides, as $SiO_2$.

3. A voltage non-linear resistor as claimed in claim 1, wherein a boundary portion between said element and said layer comprises zinc silicate and a spinel $Zn_{1/3}Sb_{2/3}O_4$.

4. A VOltage non-linear resistor as claimed in claim 1, wherein said layer has a thickness of 30–100 μm.

5. A voltage non-linear resistor as claimed in claim 1, which further comprises a glassy layer superimposed on the thin insulating covering layer.

6. A voltage non-linear resistor as claimed in claim 5, wherein the glassy layer has a thickness of 50–100 μm.

7. A process for manufacturing a voltage non-linear resistor, which comprises applying a mixture comprising 80–96 mol. % silicon oxides calculated as $SiO_2$, 2–7 mol. % bismuth oxides calculated as $Bi_2O_3$ and antimony oxides for the remainder on a peripheral side surface of a disclike voltage non-linear resistance element comprising zinc oxides as a main ingredient, 0.1–2.0 mol. % bismuth oxides calculated as $Bi_2O_3$, 0.1–2.0 mol. % cobalt oxides calculated as $Co_2O_3$, 0.1–2.0 mol. % manganese oxides calculated as $MnO_2$, 0.1–2.0 mol. % antimony oxides calculated as $Sb_2O_3$, 0.1–2.0 mol. % chromium oxides calculated as $Cr_2O_3$, 0.1–2.0 mol. % nickel oxides calculated as NiO, 0.001–0.05 mol. % aluminum oxides calculated as $Al_2O_3$, 0.005–0.1 mol. % boron oxides calculated as $B_2O_3$, 0.001–0.05 mol. % silver oxides calculated as $Ag_2O$ and 1–3 mol. % silicon oxides calculated as $SiO_2$, and then sintering the element, whereby an insulating covering layer is provided integrally on said surface.

8. A process as claimed in claim 7, wherein said element comprises 0.5–1.2 mol. % bismuth oxides, as $Bi_2O_3$, $0.5_{1.5}$ mol. % cobalt oxides, as $Co_2O_3$, 0.3–0.7 mol. % manganese oxides, as $MnO_2$, 0.8–1.2 mol. % antimony oxides, as $Sb_2O_3$, 0.3–0.7 mol. % chromium oxide, as $Cr_2O_3$, 0.8–1.2 mol. % nickel oxides, as NiO, 0.002–0.005 mol. % aluminum oxides, as $Al_2O_3$, 0.01–0.08 mol. % boron oxides, as $B_2O_3$, 0.005–0.03 mol. % silver oxides, as $Ag_2O$, and 1.5–2.0 mol. % silicon oxides, as $SiO_2$, and said mixture comprises 85–90 mol. % silicon oxides, as $SiO_2$.

9. A process as claimed in claim 7, wherein said mixture is applied as a paste containing an organic binder with a thickness of 60–300 μm.

10. A process as claimed in claim 7, which further comprises applying a glass paste comprising glass powder admixed with an organic binder, with a thickness of 100–300 μm onto the insulating covering layer and heat-treating to form a glassy layer 50–100 μm thick superimposed upon the insulating covering layer.

* * * * *